US006295710B1

(12) United States Patent
Roberts et al.

(10) Patent No.: US 6,295,710 B1
(45) **Date of Patent: *Oct. 2, 2001**

(54) AUTOMATIC FASTENING MACHINE AND METHOD

(75) Inventors: Bradly M. Roberts, Williamsville; Robert J. Kellner, Orchard Park; Thomas E. Burns, Williamsville; Kurt R. Kubanek, Tonawanda, all of NY (US)

(73) Assignee: General Electro Mechanical Corporation, West Seneca, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/321,445

(22) Filed: May 27, 1999

Related U.S. Application Data

(60) Provisional application No. 60/086,907, filed on May 27, 1998.

(51) Int. Cl.[7] ..... B23Q 17/00

(52) U.S. Cl. ..... 29/407.01; 29/251; 29/559; 29/281.4; 29/798; 100/269.2; 100/226; 269/73; 227/152

(58) Field of Search ..... 29/407.01, 251, 29/559, 281.4, 798; 100/269.2, 226, 233, 269.06, 269.08, 258 R; 269/73; 227/152, 153

(56) References Cited

U.S. PATENT DOCUMENTS

| | | | | |
|---|---|---|---|---|
| 3,874,070 | * | 4/1975 | Falcioni | 29/526 |
| 4,382,728 | * | 5/1983 | Anderson et al. | 409/137 |
| 4,717,291 | * | 1/1988 | Zafir | 408/13 |
| 4,828,474 | * | 5/1989 | Ballantyne | 425/150 |
| 4,873,923 | * | 10/1989 | Manning | 100/258 R |
| 4,908,928 | * | 3/1990 | Mazurik et al. | 29/243.54 |
| 4,998,943 | * | 3/1991 | Roberts et al. | 29/432.2 |
| 5,060,362 | * | 10/1991 | Birke et al. | 29/525.2 |
| 5,222,289 | * | 6/1993 | Michalewski et al. | 29/524.1 |
| 5,357,668 | * | 10/1994 | Roberts | 29/559 |
| 5,477,597 | * | 12/1995 | Catania et al. | 29/34 B |

FOREIGN PATENT DOCUMENTS

WO98/13156 * 4/1998 (WO) .

* cited by examiner

*Primary Examiner*—S. Thomas Hughes
*Assistant Examiner*—John C. Hong
(74) *Attorney, Agent, or Firm*—Hodgson Russ LLP

(57) ABSTRACT

An automatic fastening machine and method which reduces fastener installation cycle time by virtue of unique tool movements, pressure foot operation and other features. The pressure foot plate is coupled to actuators for moving the same in a manner allowing tilting of the plate relative to the plane of the workpiece during movement from one fastener installation location to another. The actuators are independently operated by a servo control arrangement in conjunction with the machine control. As a result, it is not necessary for the system to seek a new down position thereby saving machine cycle time. Sensors operatively associated with the actuators in conjunction with the machine control cause movement of the pressure foot plate in reaction to force applied to the workpiece during fastener installation to maintain the workline established by the position of the workpiece prior to application of force. The clamp of the lower ram is driven positively during both upward and downward strokes so as to save cycle time. The lower ram tool is rotated in a manner which does not interfere with other components on the lower ram assembly. A new and improved slug riveting process also is provided by the machine and method.

23 Claims, 14 Drawing Sheets

AUTOMATIC FASTENING MACHINE AND METHOD

CROSS-REFERENCE TO A RELATED APPLICATION

Applicants hereby claim priority based on Provisional Application No. 60/086,907 filed on May 27, 1998 and entitled "Automatic Fastening Machine and Method" which is incorporated herein by reference.

BACKGROUND OF THE INVENTION

An important consideration in the design of automatic fastening machines is reduction in the overall cycle time for installation of a fastener. This can involve aspects of the movements of individual tools and other components of the machine.

Other important considerations involve forces encountered by machine components such as the pressure foot and the need to orient clamping tools to accommodate shapes of details being fastened.

SUMMARY OF THE INVENTION

The present invention provides an automatic fastening machine and method which reduces fastener installation cycle time by virtue of unique tool movements, pressure foot operation and other features. In particular, the pressure foot plate is coupled to motive means for moving the same in a manner allowing tilting of the plate relative to the plane of the workpiece during movement from one fastener installation location to another. The motive means are independently operated by a servo control arrangement in conjunction with the machine control. As a result, it is not necessary for the system to seek a new down position thereby saving machine cycle time. Sensors operatively associated with the motive means in conjunction with the machine control cause movement of the pressure foot plate in reaction to force applied to the workpiece during fastener installation to maintain the workline established by the position of the workpiece prior to application of force. The clamp of the lower ram is driven positively during both upward and downward strokes so as to save cycle time. The lower ram tool is rotated in a matter which does not interfere with other components on the lower ram assembly. A new and improved slug riveting process also is provided by the machine and method of the present invention.

The following detailed description of the invention, when read in conjunction with the accompanying drawings wherein the same reference numerals denote the same or similar parts throughout the several views, is in such full, clear, concise and exact terms as to enable any person skilled in the art to which it pertains, or with which it is mostly nearly connected, to make and use the invention.

DETAILED DESCRIPTION OF THE ILLUSTRATED EMBODIMENT

Figure 1:
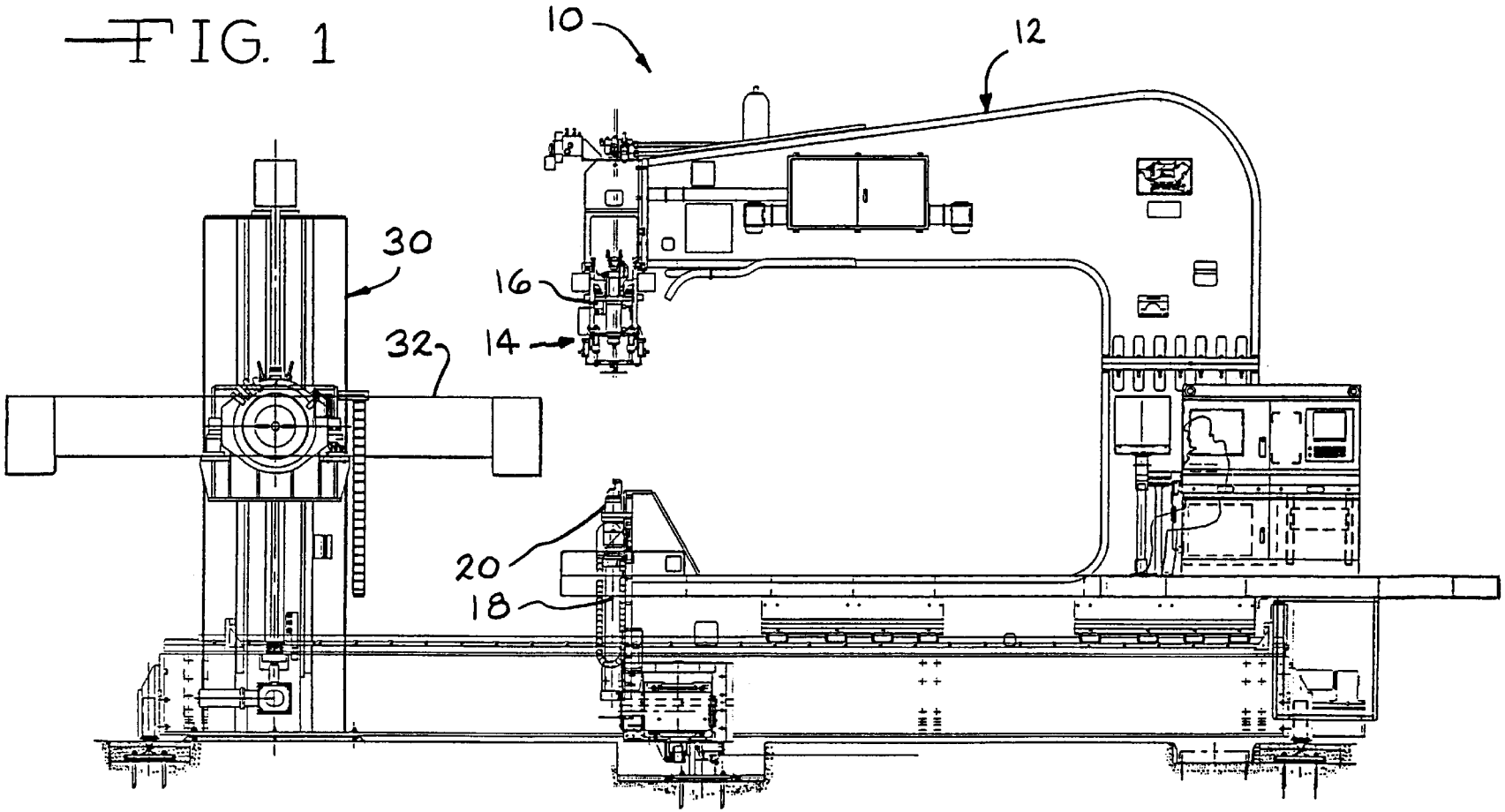
FIG. 1 is a side elevational view of the machine of the present invention.

The machine 10 of the present invention is illustrated in FIG. 1. Briefly, a frame 12 of generally C-shape carries an upper head assembly 14 and transfer assembly 16 on the upper leg of the C-frame as viewed in FIG. 1. The lower leg of the C-frame 12 supports a lower ram assembly 18 and a lower clamp assembly 20. Frame 12 is movable along rails on a supporting surface such as the floor of a factory in a known manner. A work positioner 30 holds a workframe 32 which supports and manipulates a workplace (not shown) into which fasteners are to be installed by machine 10.

Figure 2:
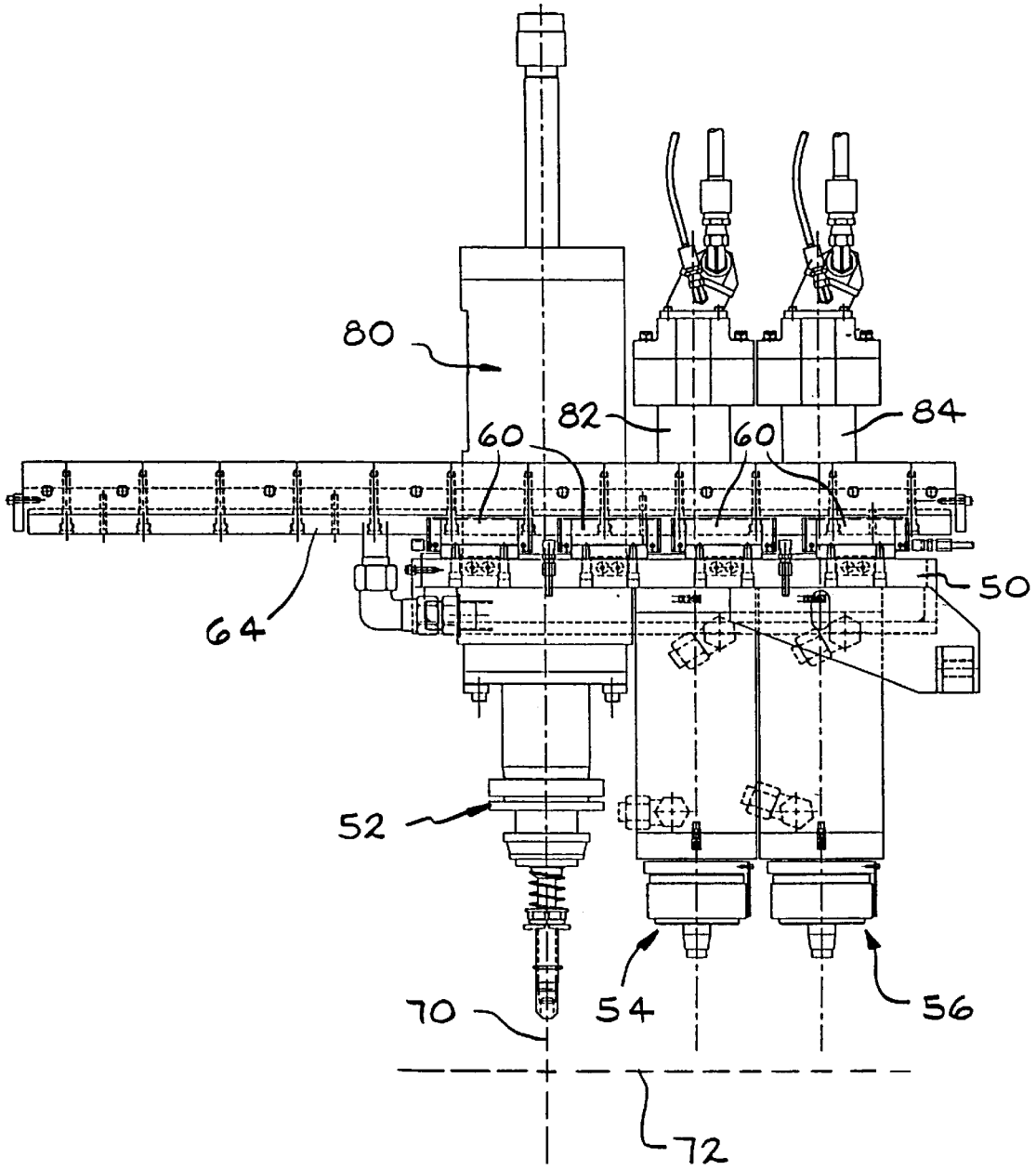
FIG. 2 is a fragmentary side elevational view of the transfer assembly in the upper head of the machine of FIG. 1.
Figure 3:
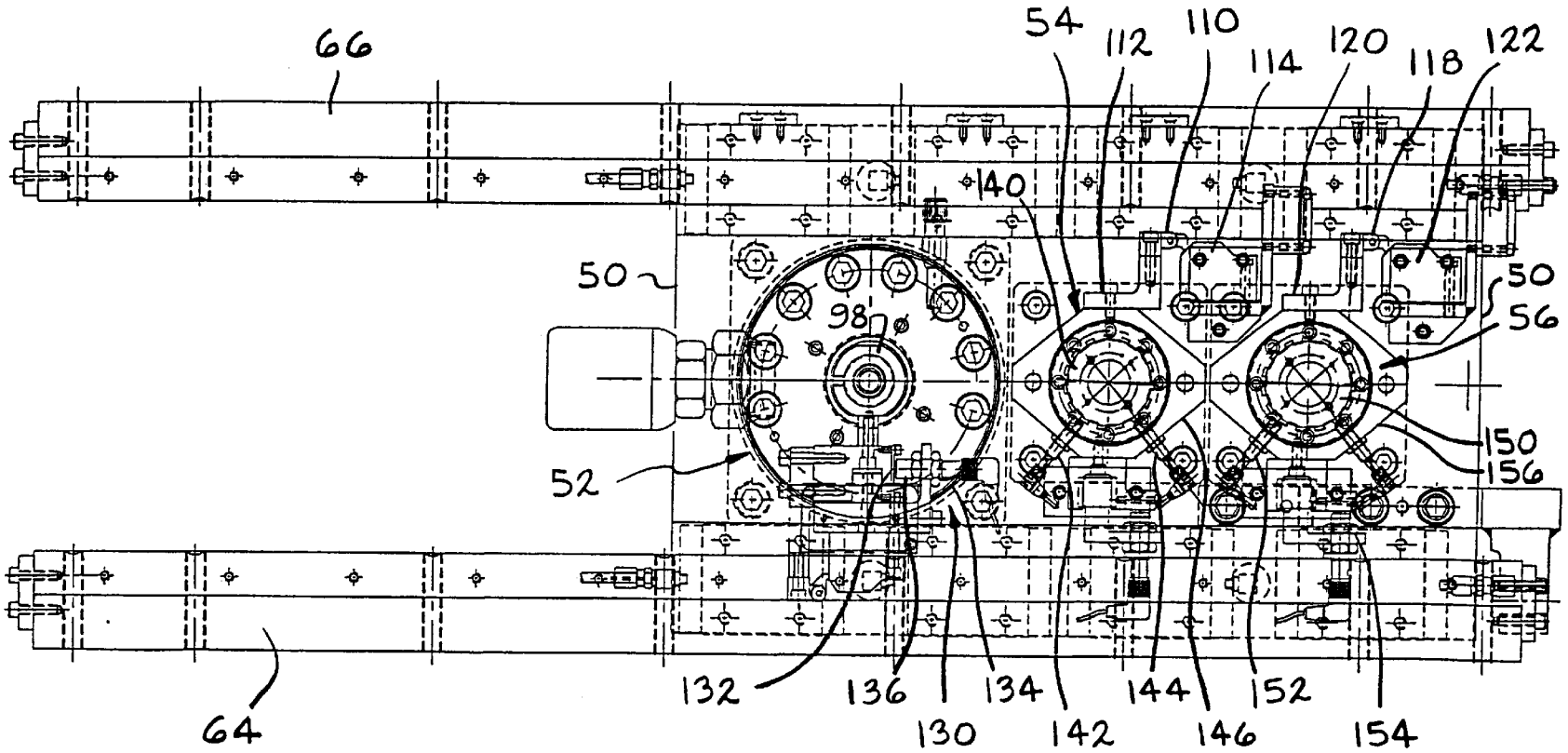
FIG. 3 is a top plan view of the assembly of FIG. 2.
Figure 4:
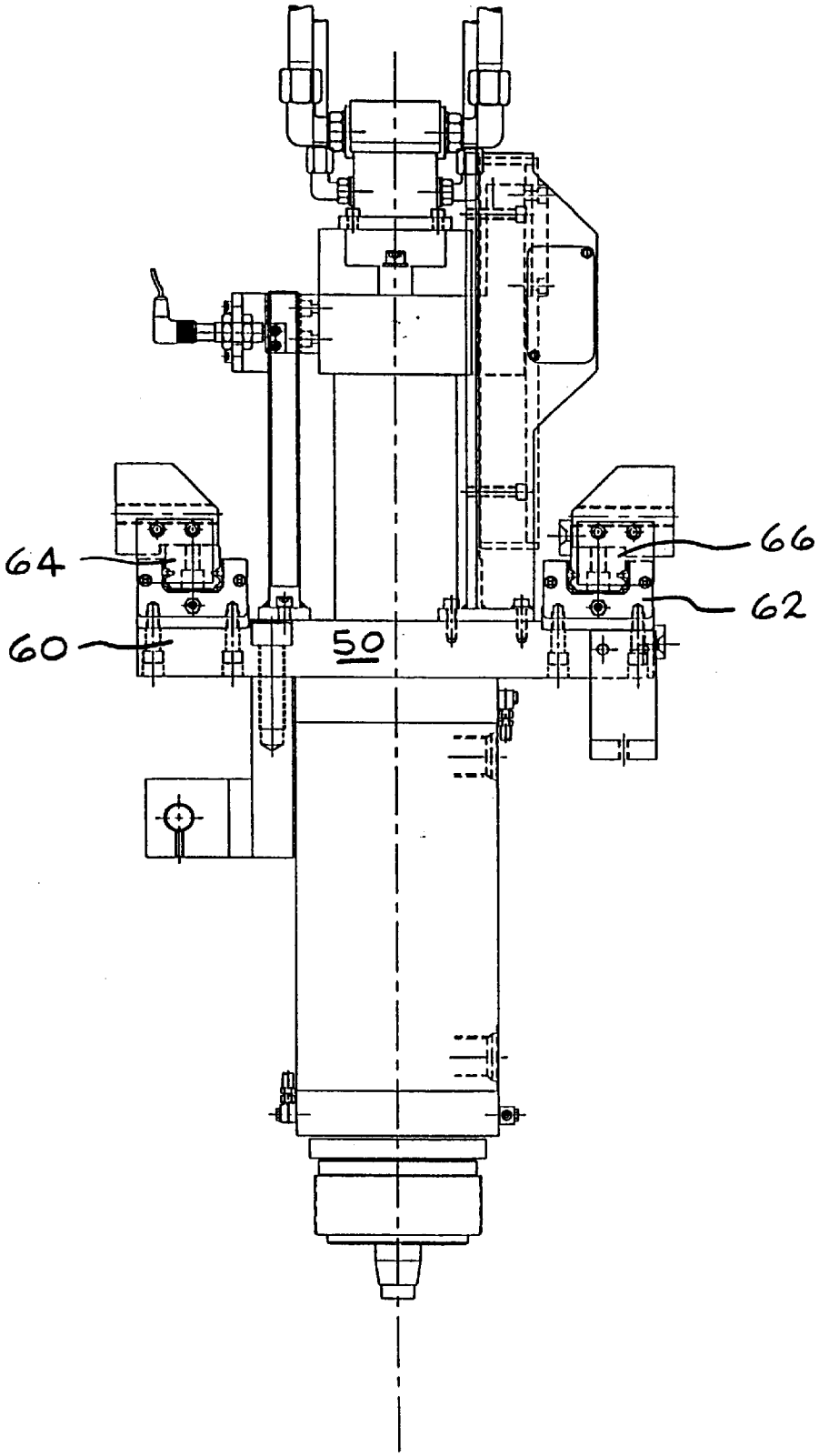
FIG. 4 is a right-hand end elevational view thereof.

FIGS. 2–6 illustrate the transfer assembly of the machine wherein a transfer plate 50 carries a plurality of tools, for example a bucking tool generally designated 52, a shave tool generally designated 54 and a drill generally designated 56. The tools have housings mounted at their upper ends to the transfer plate 50, and have components moveable toward and away from the workpiece in a manner which will be described. The transfer plate 50, in turn, is movably supported in the machine frame by means of linear bearings fixed to transfer plate 50 which engage spaced-apart, parallel rails extending along an upper head assembly within the machine frame. For example, the bearing and rail arrangement can be NSK type. A plurality of bearing assemblies 60 are mounted to transfer plate 50 along one side edge thereof as shown in FIG. 2. A corresponding plurality of bearing assemblies 62 are mounted along the opposite side of plate 50, one of which bearing assemblies 62 is shown in FIG. 4. A pair of rail assemblies 64 and 66 are mounted to the upper head assembly within the machine frame and are engaged by the bearings 60, 62 in a known manner. Transfer plate 50 is moved linearly in the direction of rails 64, 66 by motive means such as a transfer cylinder under control of a servo valve. Thus, movement of transfer plate 50 under control of the servo valve moves the tools individually into and out of alignment with a work axis 70. Axis 70 is substantially perpendicular to the workline 72 which, in turn, is disposed in the plane of the workpiece. The rod of the transfer cylinder (not shown) is connected to a bracket 76 which, in turn, is mounted to transfer plate 50 as shown in FIGS. 2 and 4. The instantaneous position of transfer plate 50 is sensed and monitored by an encoder assembly wherein the encoder read head is carried by bracket 78 mounted on plate 50 as shown in FIG. 4 and the encoder scale is mounted to the upper head assembly within the machine frame in a manner which will be described.

Figure 5:
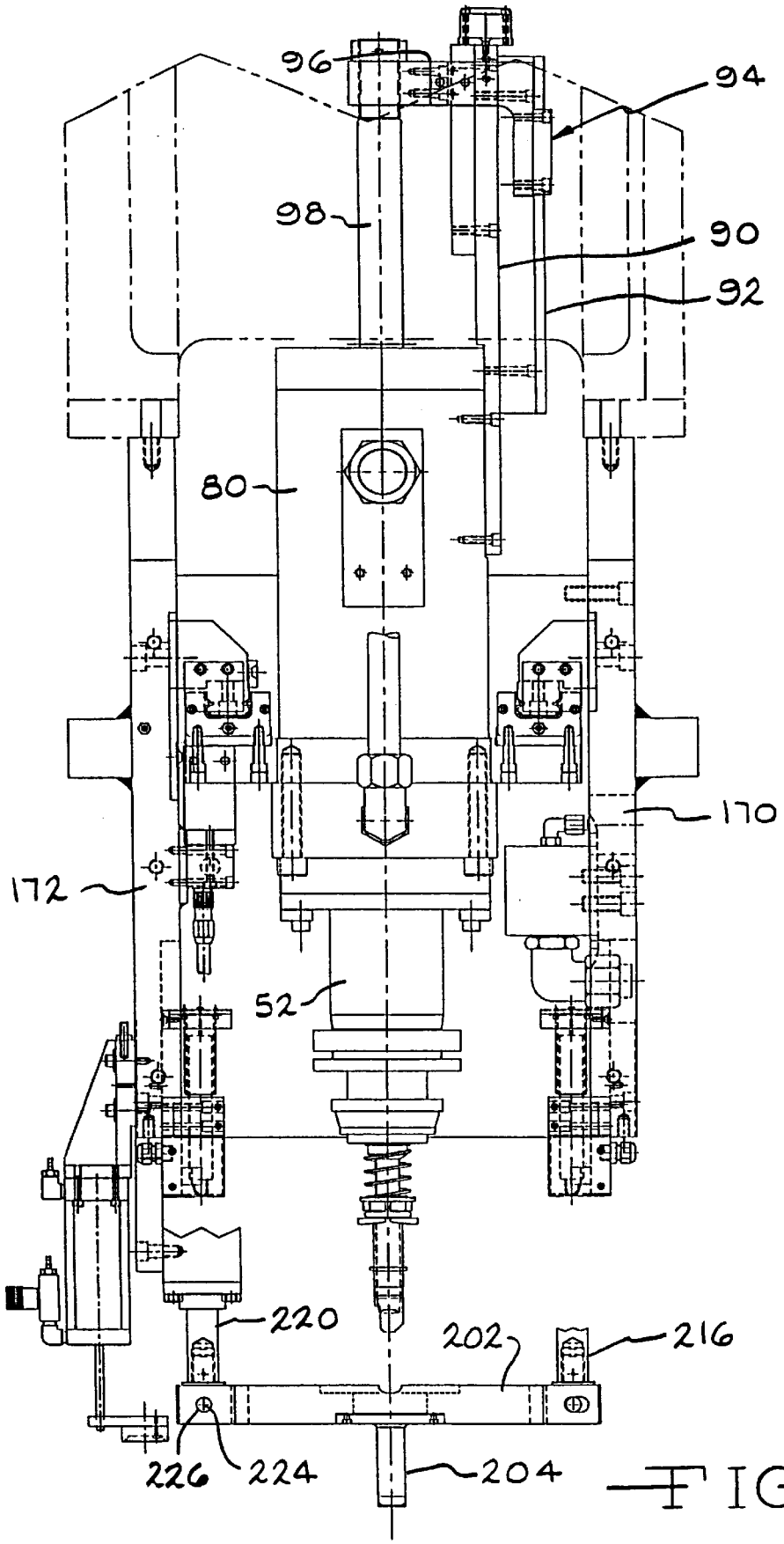
FIG. 5 is a left-hand end elevational view of the upper head of the machine of FIG. 1.

Each of the tools is moved toward and away from the workpiece by motive means which by way of example are shown in the form of hydraulic cylinders. Other suitable motive means such as ball screw arrangements, electrically-operated roller screw actuators such as that shown in U.S. Pat. No. 5,829,115, and others can be employed. Thus, bucking tool 52 is moved toward and away from the workpiece by an hydraulic cylinder generally designated 80 in FIG. 2. Likewise shave and drill tools 54 and 56, respectively are moved toward and away from the workpiece by means of hydraulic cylinders 82 and 84, respectively. The distance travelled by each of the tools is instantaneously sensed and measured by means of an encoder assembly associated with each of the tools, which encoders preferably are of the glass scale type. For example, and as shown in FIG. 5, an encoder mounting bar 90 is fixed to the housing of buck cylinder 80 and a glass scale encoder 92 is fixed to mounting bar 90. An encoder head assembly 94 is carried by a mounting bracket 96, which in turn, is fixed to the end of rod 98 of cylinder 80. Head 94 is movable along scale 92. Thus, as rod 98 moves during movement of bucking tool 52 toward and away from the workpiece, the corresponding movement of rod 98 is measured by the movement of encoder head 94 along scale 92. Electrical signals containing information on the instantaneous position of tool 52 are sent to the machine control system via cables (not shown) leading to the machine control.

Similar arrangements are provided for the shave, drill and other tools of the machine. For example and referring to FIG. 3, an encoder head assembly 110 is carried by the rod of shave cylinder 82, being fixed thereto by means of a mounting bracket 112. An assembly 114 containing the glass scale encoder is mounted to the machine whereby as shave tool 54 moves toward and away from the workpiece, the encoder head moves along the encoder scale. Similarly, an encoder head assembly 118 is carried by the rod of drill cylinder 84, being fixed thereto by means of a mounting bracket 120. An assembly 122 containing the glass scale encoder is mounted to the transfer assembly. The encoders, in turn, are connected to the machine control to provide it with information as to the linear position of each of the tools 54, 56 relative to the workpiece in a manner similar to that previously described in connection with bucking tool 52.

As shown in FIG. 3 a proximity switch assembly generally designated 130 is associated with bucking tool 52 to indicate the full up position of the tool 52 relative to the workpiece. Assembly 130 includes a first component in the form of a switch sensing plate 132 carried by the rod 98 of cylinder 80 and movable therewith. A second component in the form of switch sensor 134 is fixed to the machine frame by means of mounting bracket 136. Sensor 134 is located so as to be in registry with plate 132 when tool 52 is in the full up position relative to the workpiece, and sensor 134 is connected electrically to the machine control to signal the full up position of tool 52 to the control.

Each of the tools 54 and 56 is provided with a sensing arrangement to provide information on the speed and direction of rotation of the rotating component of the tool. For example, a toothed wheel 140 is provided on the rotating shaft of shave tool 54 so as to rotate therewith. A pair of spaced-apart electro-optical, electromagnetic or other suitable sensor/pickup devices 142 and 144 are mounted into an adaptor 146 carried by the frame of the shave tool 54. Sensors 142 and 144 are located and disposed toward the teeth of wheel 140 so as to provide electrical pulse signal information to the machine control as to the direction and speed of rotation of shave tool 54. Similarly, a toothed wheel 150, sensors 152 and 154 and mounting adaptor 156 are provided for drill 56 so as to provide the machine control with information on the speed and direction of rotation of the drill. For a more detailed description of the foregoing sensing arrangements, reference may be made to pending U.S. patent application Ser. No. 08/937,979 filed Sep. 26, 1997 entitled "Control System And Method For Automatic Fastening Machines" and assigned to the assignee of the present invention.

Figure 6:
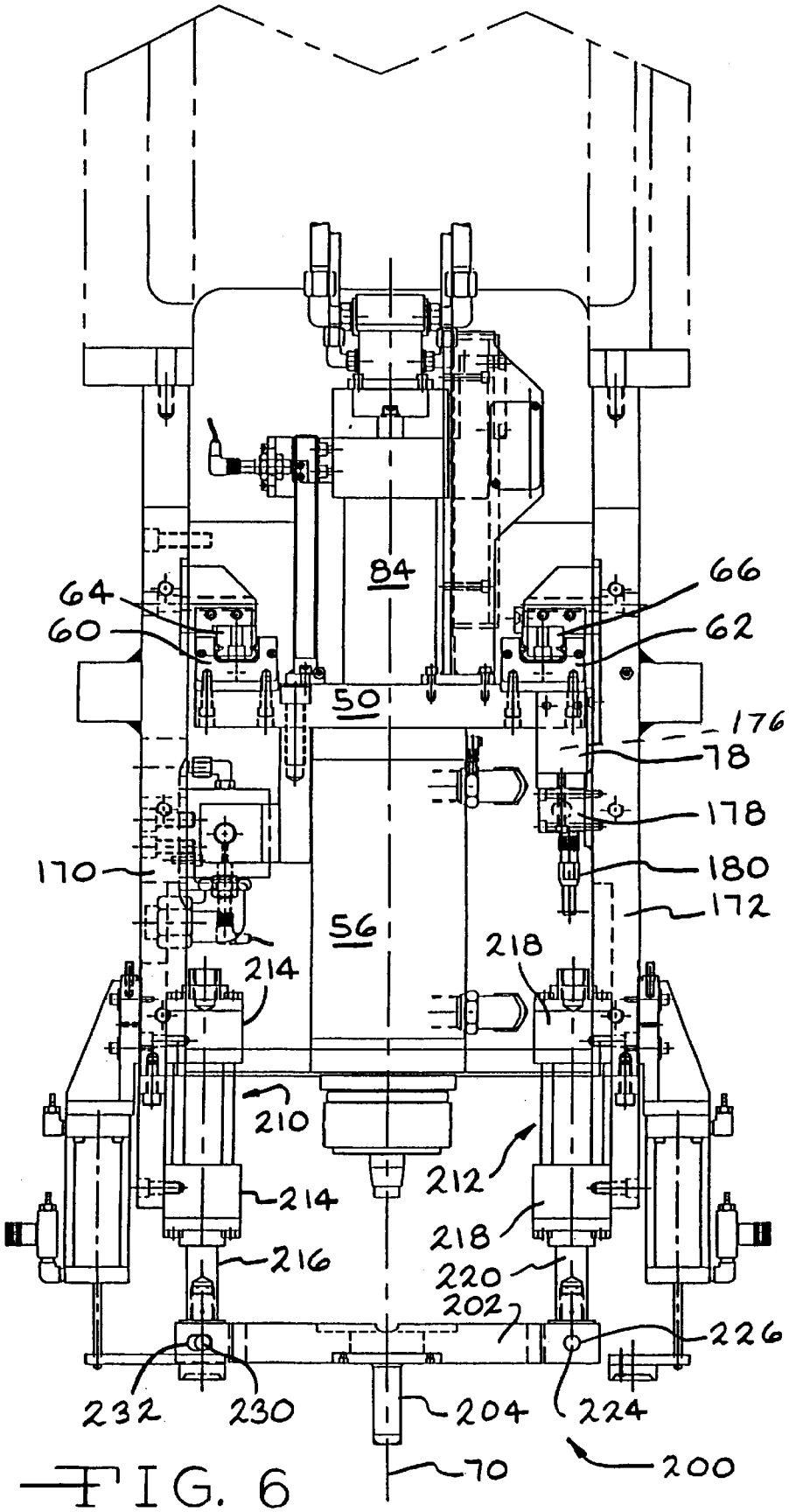
FIG. 6 is a right-hand elevational view thereof.
Figure 7:
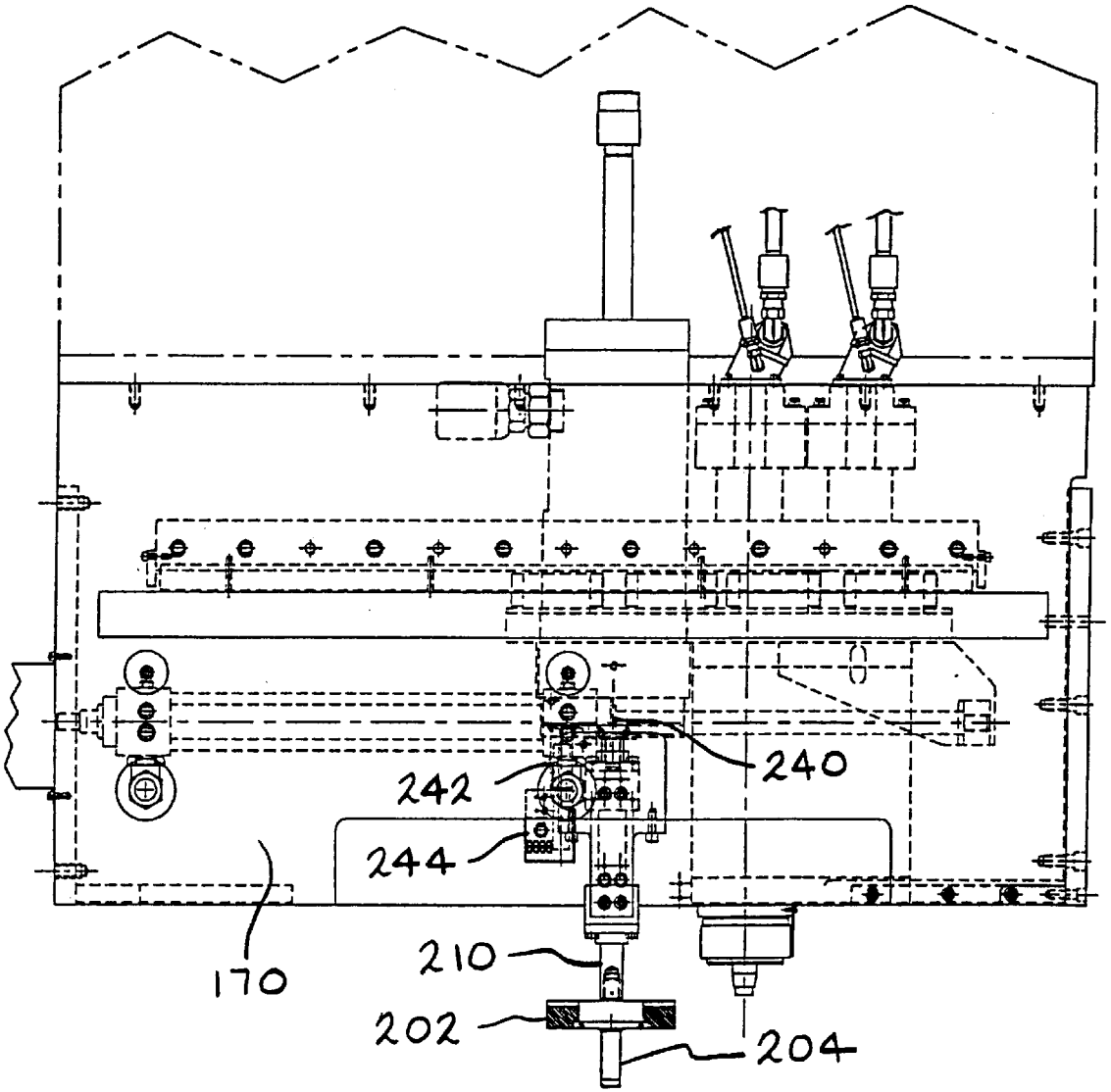
FIG. 7 is a side elevational view with parts removed of the upper head assembly of FIG. 5 and 6.

FIGS. 5–7 further illustrate the upper head assembly of the machine of the present invention. Transfer plate 50, previously described, is movably supported in the upper head frame by means of the bearing assemblies 60, 62 and rail assemblies 64 and 66 previously described. As shown in FIGS. 5–7, rail assemblies 64 and 66 are mounted to a pair of spaced apart, substantially parallel head frame members 170 and 172. The transfer plate encoder assembly, previously described, is shown in further detail in FIG. 6. The encoder read head 176 is carried by bracket 78 mounted on plate 50, and the encoder scale, in particular the glass scale of the encoder assembly, is contained in a housing 178 fixed to the head frame 172. Transfer plate 50 as viewed in FIG. 6 moves in a direction into and out of the plane of the paper, and, likewise, the glass scale of the encoder extends in a direction substantially perpendicular to the plane of the paper and thus parallel to the plane of transfer plate 50. A proximity sensor 180 establishes a home reference for the transfer assembly and which is utilized by the machine control.

The upper head assembly includes a pressure foot assembly generally designated 200 according to the present invention. Pressure foot assembly 200 includes a pressure plate 202 which is disposed in a plane generally parallel to the plane of the work piece. A pressure foot bushing 204 depends from plate 202. A central opening or passage extends through both plate 202 and bushing 204 to receive tools and fasteners in a known manner. The central longitudinal axis of bushing 204 is disposed coincident with the work axis 70 during operation of the machine. The plane of pressure foot plate 202 is disposed substantially parallel to work line 72 and thus substantially perpendicular to work line 70. All of the foregoing aspects of pressure foot plate 202 and bushing 204 are conventional and well known to those skilled in the art.

The pressure foot plate 202 and bushing 204 is moved toward and away from the work piece by motive means which by way of example are shown in the form of a pair of hydraulic cylinders 210 and 212 shown in FIG. 6. Other suitable motive means can be employed, such as pneumatic cylinders and ball screw and other actuators. In particular, cylinder 210 comprises a housing 214 mounted to frame component 170 and a rod 216 which is operatively connected to pressure foot plate 202 in a manner which will be described. Similarly, cylinder 212 includes a housing 218 mounted to machine frame component 172 and a rod 220 which is operatively connected to pressure foot plate 202 in a manner which will be described.

In accordance with the present invention, pressure foot plate 202 is operatively connected to the motive means in the form of cylinders 210 and 212 in an uncoupled manner allowing a tilting or rocking movement of plate 202 relative to the plane of the work piece. In particular, rod 220 of cylinder 212 is pivotally connected to plate 202 by means of the pivotal connection shown in FIG. 6, such as by means of a pin 224 connected to the end of rod 220 and pivotally received in a bore or passage 226 in the end of pressure foot plate 202. Rod 216 is connected to pressure foot plate 202 by means of a sliding connection as shown in FIG. 6. In particular, a pin 230 fixed to the end of rod 216 is received in an elongated slot 232 provided in the opposite end of pressure foot plate 202. In this regard, each end of pressure foot plate 202 can have a substantially U-shaped end formation wherein the space between the legs of the U accommodates the end of the corresponding rod and the legs are provided with the bore and slot to receive the corresponding pin.

Also in accordance with the present invention, the motive means or cylinders 210, 212 are independently operated and controlled by means of a servo control arrangement and the machine control system as will be described in further detail presently. By virtue of this independent control arrangement, when it is desired to move pressure foot 202, 204 along the workpiece, it is necessary only to operate cylinder 210 to retract rod 216 slightly thereby pivoting plate 202 about pin 224 and lifting the end adjacent the connection 230, 232. Alternatively, cylinder 212 could be operated to retract rod 220. Thus, pressure foot 202, 204 can be tipped while the machine moves it to a new location on the workpiece, rather than moving the entire pressure foot 202, 204 vertically during such movement. As a result, it is not necessary for the system to seek a new down position, and the servo control system only needs to operate the one cylinder such as cylinder 210 which in turn is beneficial to operation of the servo control system. The foregoing advantageously results in a saving of machine cycle time. Another advantage of the un-coupled pressure foot assembly according to the present invention is that the entire magnitude of forces exerted by the work piece or the machine on the pressure foot plate 202 does not have to be accommodated by the cylinders 210, 212. In other words, rather than the rods 216, 220 of the cylinders 210 and 212, respectively, having to accommodate all of the friction forces in such circumstances, a portion of the frictional effects are accommodated by the play in the connection between the pressure foot 202 and rod 216 together with the pivotal connection to rod 220.

In accordance with the present invention, there is provided sensor means associated with each of the drive means 210, 212 of the pressure foot assembly. Thus, the operation of each of the motive means 210, 212 is monitored by the machine control system. Furthermore, this enables independent control of each of the drive means of the pressure foot assembly. There is a sensor assembly in the form of a linear voltage differential transducer (LVDT) provided for each of the cylinders 210, 212. The sensor arrangement for one of the cylinders is shown in FIG. 7. A bracket 240 is fixed to the upper end of the rod of cylinder 210. Bracket 240 has a leg extending outwardly therefrom to which is mounted the rod 242 of an LVDT assembly. Rod 242 is received in the housing 244 which contains the read head portion of the transducer assembly. Housing 244 is fixed to head frame member 170. The pressure foot assembly is shown in FIG. 7 in its lowermost position. As the pressure foot assembly is raised, the rod of cylinder 210 moves upwardly as viewed in FIG. 7 thereby moving rod 242 within housing 244 and providing an indication of the degree of movement of cylinder 210. This is transmitted by electrical conductors to the machine control. An identical arrangement of mounting bracket on the cylinder rod and LVDT assembly is provided for cylinder 212.

The sensors associated with each of the pressure foot cylinders 210, 212 control the location of workline 72 and can maintain this location in space throughout the fastening or riveting process. In particular, deflection of the machine C-frame 12 wants to move the pressure foot away from the starting workline 72. The encoders can be used to advance the pressure foot a known amount in reaction to the fastener or rivet forming force to maintain the initial position. The information sent from the encoders to the machine control then enables the control to operate cylinders 210, 212 to move pressure foot 202, 204 to maintain contact with the workpiece. This also enables the machine control to automatically adjust the strokes of the tools as the location of workline 72 changes. It is also possible to change the workline location as in the case of a wing spar assembly that has steps in the workpiece surface when it is desired to maintain the workpiece in a static location.

Figure 8:
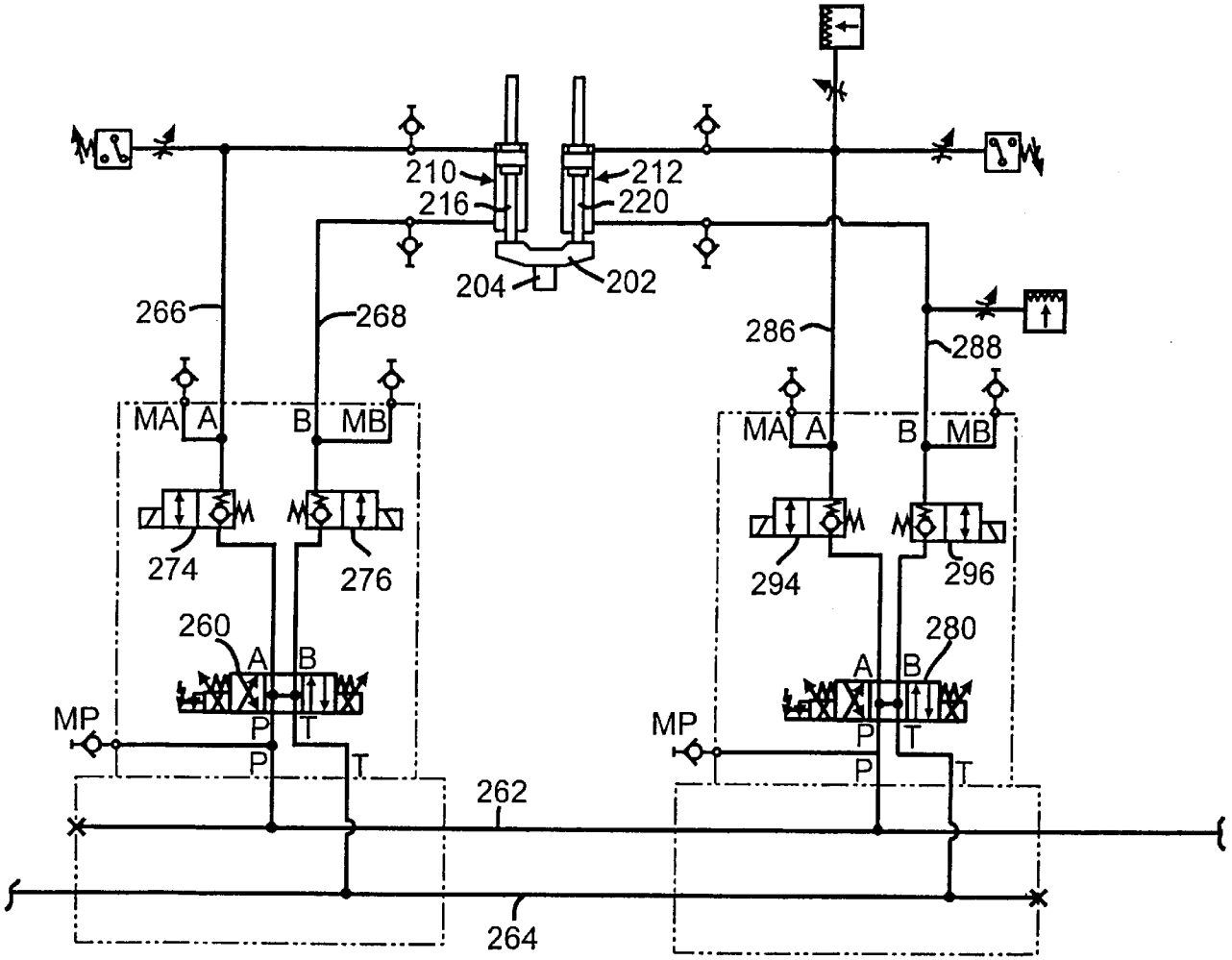
FIG. 8 is a schematic diagram of the fluid circuit for the pressure foot in the machine of FIG. 1.

The independent operation of pressure foot cylinders 210, 212 is illustrated further by the fluid circuit diagram of FIG. 8. A first servo-controlled valve 260 selectively connects pressure line 262 and tank line 264 to opposite ends of cylinder 210 via lines 266 and 268. Control valves 274 and 276 connected in lines 266 and 268, respectively, are of the on-off type. Similarly, a second servo-controlled valve 280 selectively connects pressure line 262 and tank line 264 to opposite ends of pressure foot cylinder 212 via lines 286 and 288. On-off control valves 294 and 296 are connected in lines 286 and 288. Servo valves 260 and 280 control the speed and position of the rods of cylinders 210, 212 connected to pressure foot 202, 204. Valves 274, 276 and 294, 296 are used to lock or hold pressure foot 202, 204 in any desired position.

Thus, when it is desired to lower pressure foot 202, 204, servo valves 260 and 280 connect pressure line 262 to lines 266 and 286 and connect tank line 264 to lines 268 and 288. Servo valves 260 and 280 also control the rate at which pressure foot 202, 204 is lowered. During such movement, valves 274, 276 and 294, 296 are open. If it is desired to hold pressure foot 202, 204 at some location between its uppermost and lowermost position, valves 274, 276 and 294, 296 are switched to a closed position. These valves also can be closed to hold pressure foot 202, 204 in its uppermost or lowermost position. The operation of valves 260, 280, 274, 276, 294 and 296 is controlled by the machine control system.

By proceeding through a similar analysis, when pressure foot 202, 204 is to be raised, servo valves 260 and 280 connect tank line 264 to lines 266 and 286 and connect pressure line 262 to lines 268 and 288 while valves 274, 276 and 294, 296 are open. Devices 304 and 306 monitor system pressure during operation, and devices 308 and 310 are alarms which signal when system pressure is insufficient for the operation to continue.

Figure 9:
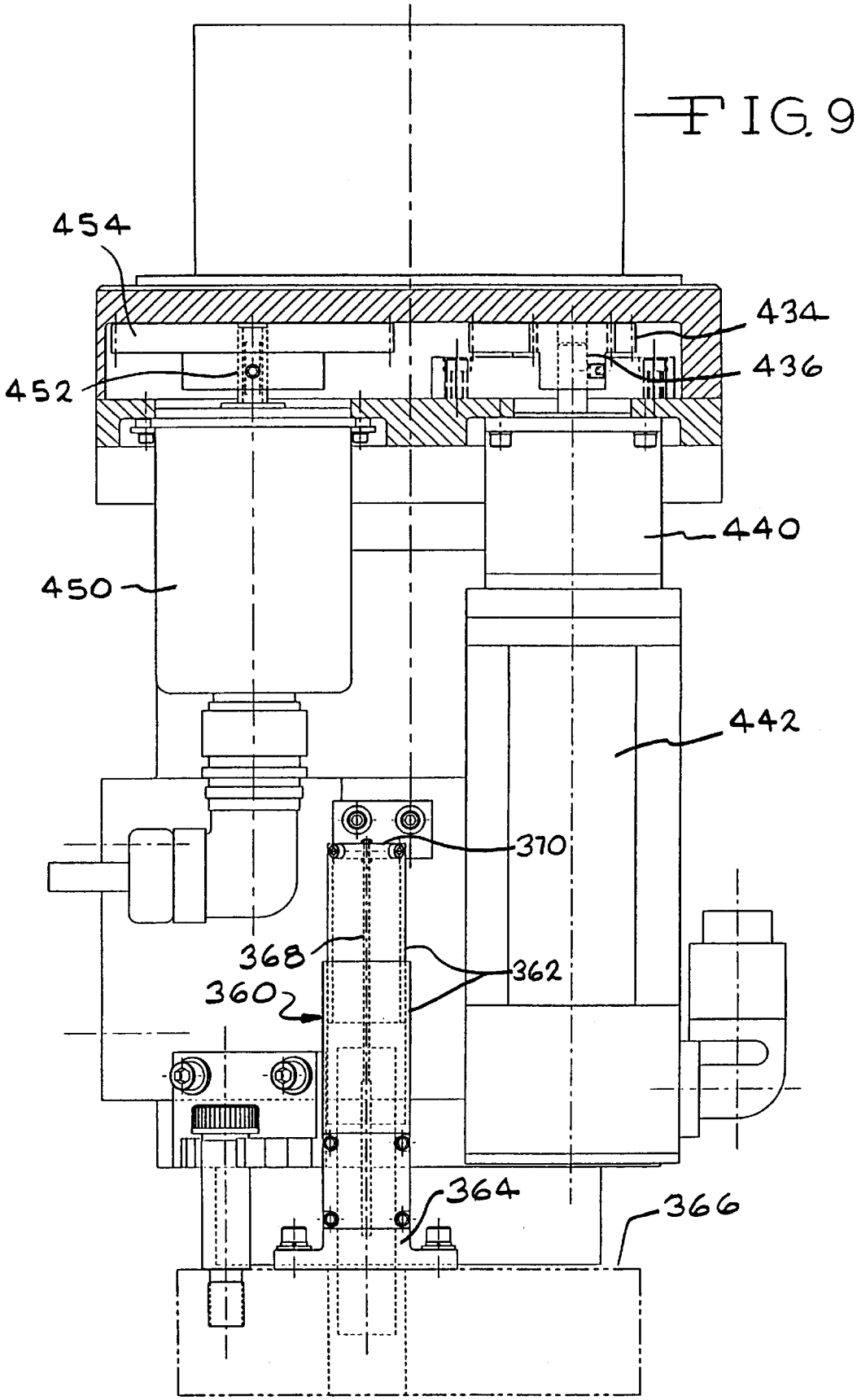
FIG. 9 is a side elevational view, partly in section, of the lower clamp assembly in the machine of FIG. 1.
Figure 10:
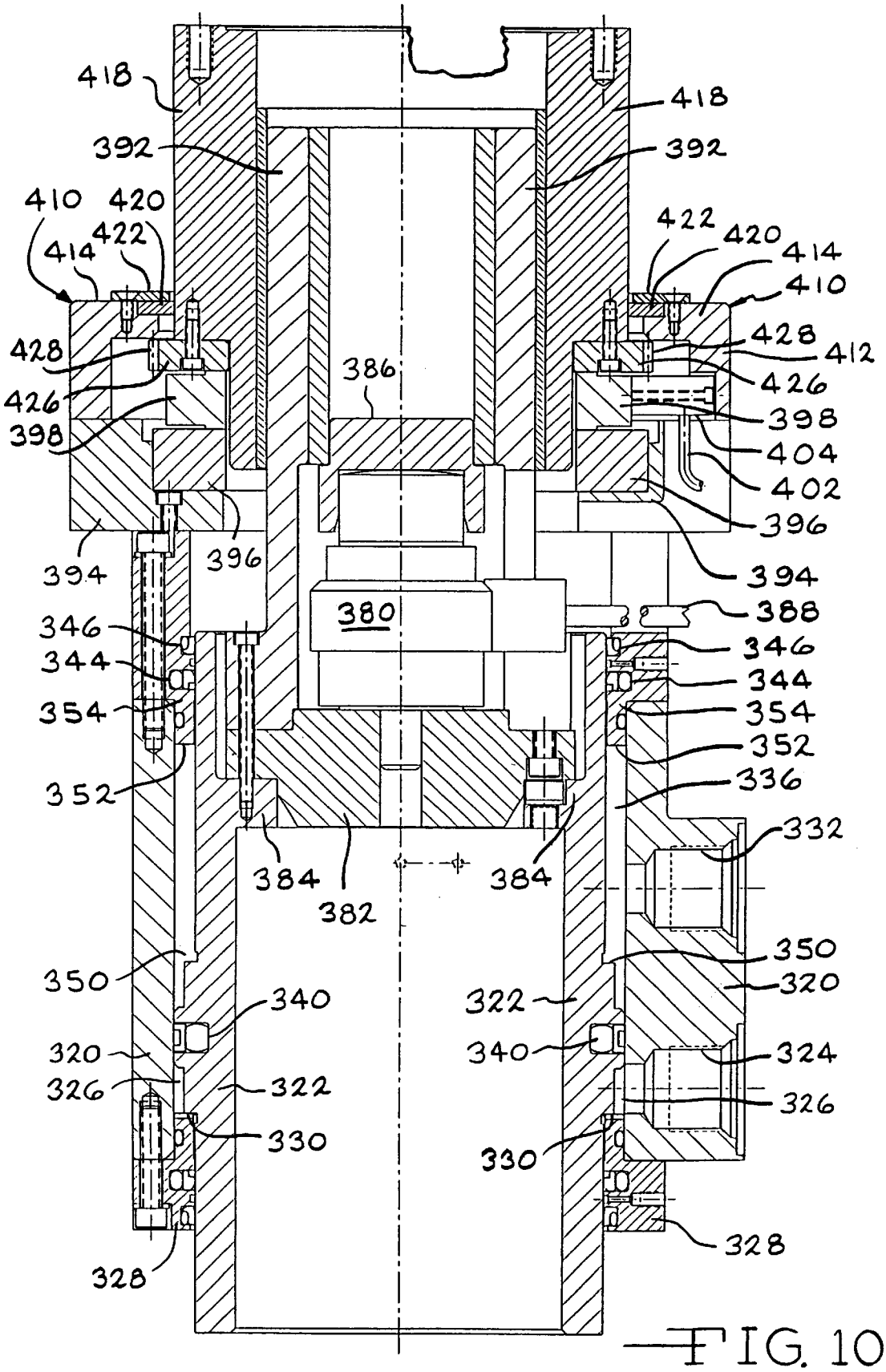
FIG. 10 is a longitudinal sectional view thereof.
Figure 11:
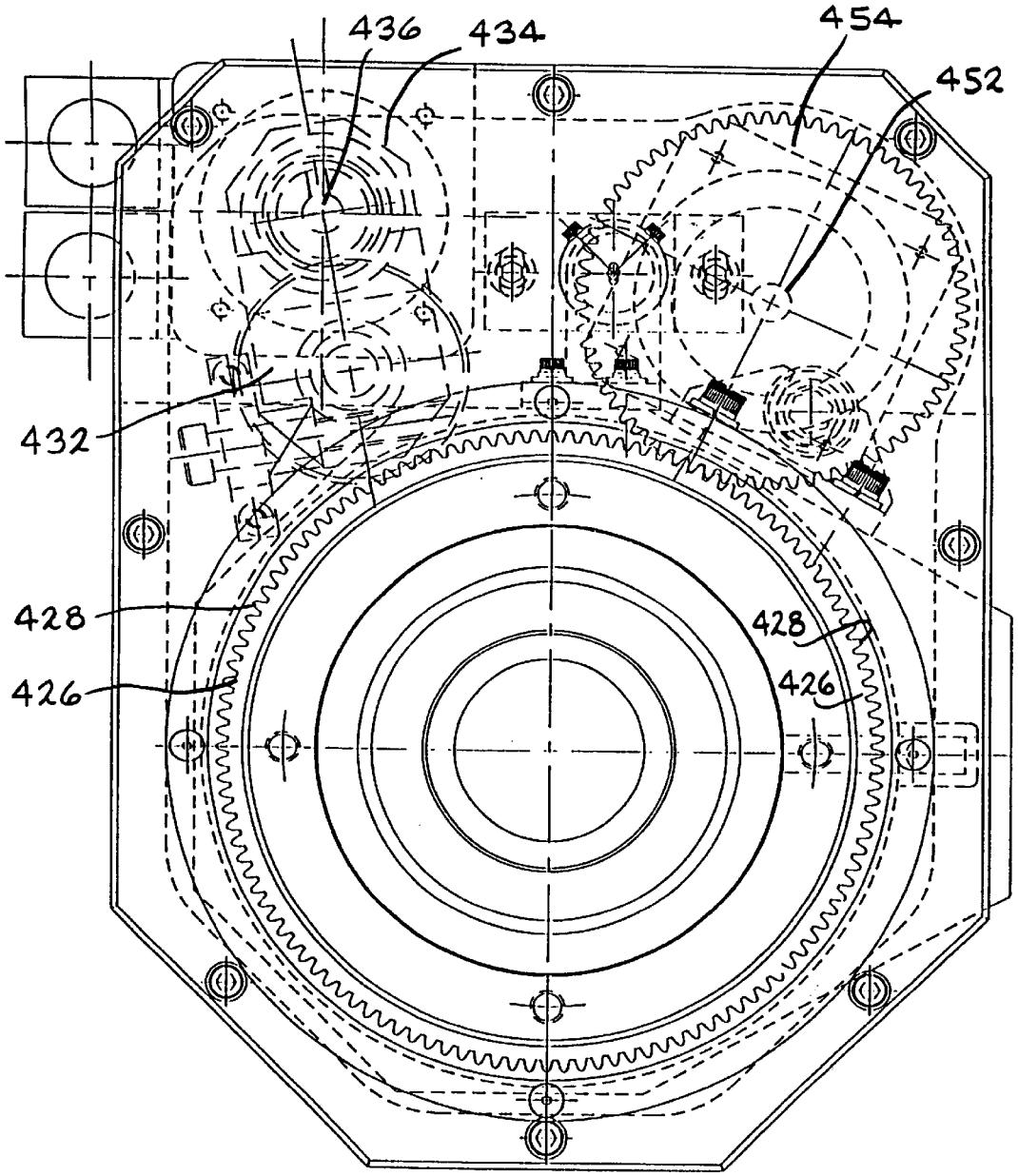
FIG. 11 is a top plan view thereof.

FIGS. 9–11 illustrate the clamp and turn table assembly on the lower ram of the machine of the present invention. As compared to prior arrangements wherein the lower clamp was driven on the upstroke and collapsed on the downstroke, in the lower clamp according to the present invention, it is positively driven in both the upward and downward strokes thereof. The lower clamp cylinder body 320 surrounds the lower clamp piston 322. The body of cylinder 320 is provided with a first passage 324 connected to the hydraulic system and which communicates with an annular chamber 326 defined between piston 322 and cylinder body 320. An annular bushing 328 carried by cylinder 320 engages an annular shoulder 330 in piston 322 thereby establishing the lowermost position of piston 322. Appropriate seals are provided in bushing 328 for sealing the chamber 326. A second passage 332 is provided in cylinder body 320 which is connected to the hydraulic system and which is in fluid communication with a second annular chamber 336 defined between cylinder body 320 and piston 322. An annular seal assembly 340 provides sealing and fluid isolation between the chambers 326 and 336. Another pair of seal assemblies 344, 346 provides fluid isolation between chamber 336 and the remainder of the assembly.

The assembly is shown in the upper position of the clamp in FIG. 10. When it is desired to lower the clamp, the hydraulic system is operated to withdraw fluid from chamber 336 through passage 332 and to introduce fluid to chamber 326 through passage 324 thereby moving cylinder body 320 downwardly as viewed in FIG. 10. The lowermost position of cylinder body 320 is established by means of engagement between an annular ledge 350 on piston 322 and the axial end 352 of a sleeve 354 fixed within cylinder 320. When it is desired to raise cylinder body 320, the reverse operation occurs, i.e., fluid is withdrawn from chamber 336 and introduced into chamber 326. The length of the clamping stroke is measured between ledge 350 and end face 352 when the components are in the uppermost position of the clamp as shown in FIG. 10. Thus, there is a positive, double-acting action of the clamp. This makes it possible to save cycle time by moving the relatively small clamp cylinder instead of the large lower ram cylinder when changing position to the next fastener installation location.

The length of the clamping stroke, i.e. movement of cylinder body 320, is measured by a sensor in the form of a linear voltage differential transducer (LVDT) generally designated 360 in FIG. 9. LVDT 360 includes a housing 362 containing the LVDT body which is supported by a mounting base 364 fixed to a lower ram plate 366. The rod 368 of LVDT 360 is movable within housing 362 and is connected at the upper end thereof by a bracket 370 to clamp cylinder body 320. Thus, upward and downward movement of cylinder body 320 is transmitted to rod 368 moving it within the body of LVDT to provide an electrical signal indurative of movement of cylinder body 320 which signal is sent to the machine control system.

A load cell 380 for measuring upset forces is supported by a load cell seat 382 which is fixed to an annular internal ledge 384 near the upper end of piston 322 as viewed in FIG. 10. A protective cap 386 is provided on the end of load cell 380 facing the workpiece. Load cell 380 is connected to the machine control system via a conductor 388 extending from a housing 390 of load cell 380. A tool post guide sleeve 392 surrounds load cell 380 and is fixed at the lower end thereof to seat 382 and piston ledge 384.

A turntable base plate 394 is supported on the upper end of clamp cylinder body 320 as viewed in FIG. 10. An annular load cell spacer 396 is received in an internal annular shoulder formed in base plate 394. An annular clamp load cell 398 rests on spacer 396. Load cell 398, which measures clamping force provided by the assembly of FIGS. 9–11, is connected to the machine control system via a conductor 402 extending from a housing 404 of load cell 398. The clamp load cell 398 is used for closed loop control of force on the workpiece via the machine control system. As such it can be used as a panel protection device by sensing any unexpected increase in force as it may be caused by a fastener not properly positioned in the hole in the workpiece.

A turntable top plate 410 has an outer wall 412 which seats on the upper surface of turntable base plate 394. Top plate 410 has an inwardly extending wall 414 provided with a central opening which surrounds tool post guide sleeve 392 and a cylindrical turntable gear body 418 which surrounds guide sleeve 392. A wiper ring 420 fixed to wall 414 of top plate 410 by means of a ring retainer 422 contacts the outer surface of/gear body 418. An annular shoulder formed in the lower end of gear body 418 as viewed in FIG. 10 receives a ring gear 426 which is fixed to gear body 418. The teeth 428 of gear 426 are located radially outward of the outer surface of gear body 418. Gear 426 meshes with an idler gear 432 which, in turn, meshes with a drive gear 434 fixed to the output shaft 436 of a gear box 440 shown in FIG. 9 which is driven by a servo motor 442 supported on cylinder body 320. Motor 442 is operated under control of the machine control system.

Thus, gear body 418 is rotated about its longitudinal axis in either direction by operation of motor 442. This, in turn, causes rotation of the lower ram tool (not shown) to facilitate orienting the tool during riveting of spars and other details requiring different rotational orientations of the lower ram tool. In the turntable arrangement of the present invention, only the upper portion, including gear body 418 and gear 426 to which the lower ram tool is coupled, is rotated. Since the other portions of the assembly of FIGS. 9–11 are not rotated this prevents wear and stress on the electrical conductors and connectors associated with load cell 380 and clamp load cell 398, as well as the hoses connecting the hydraulic system to-passages 324 and 332.

The amount and direction of rotation of the lower ram tool is detected by an encoder 450 having an output shaft 452 fixed to a toothed encoder wheel 454 which meshes with gear 426. Information from encoder 450 is sent to the machine control system.

Figure 12:
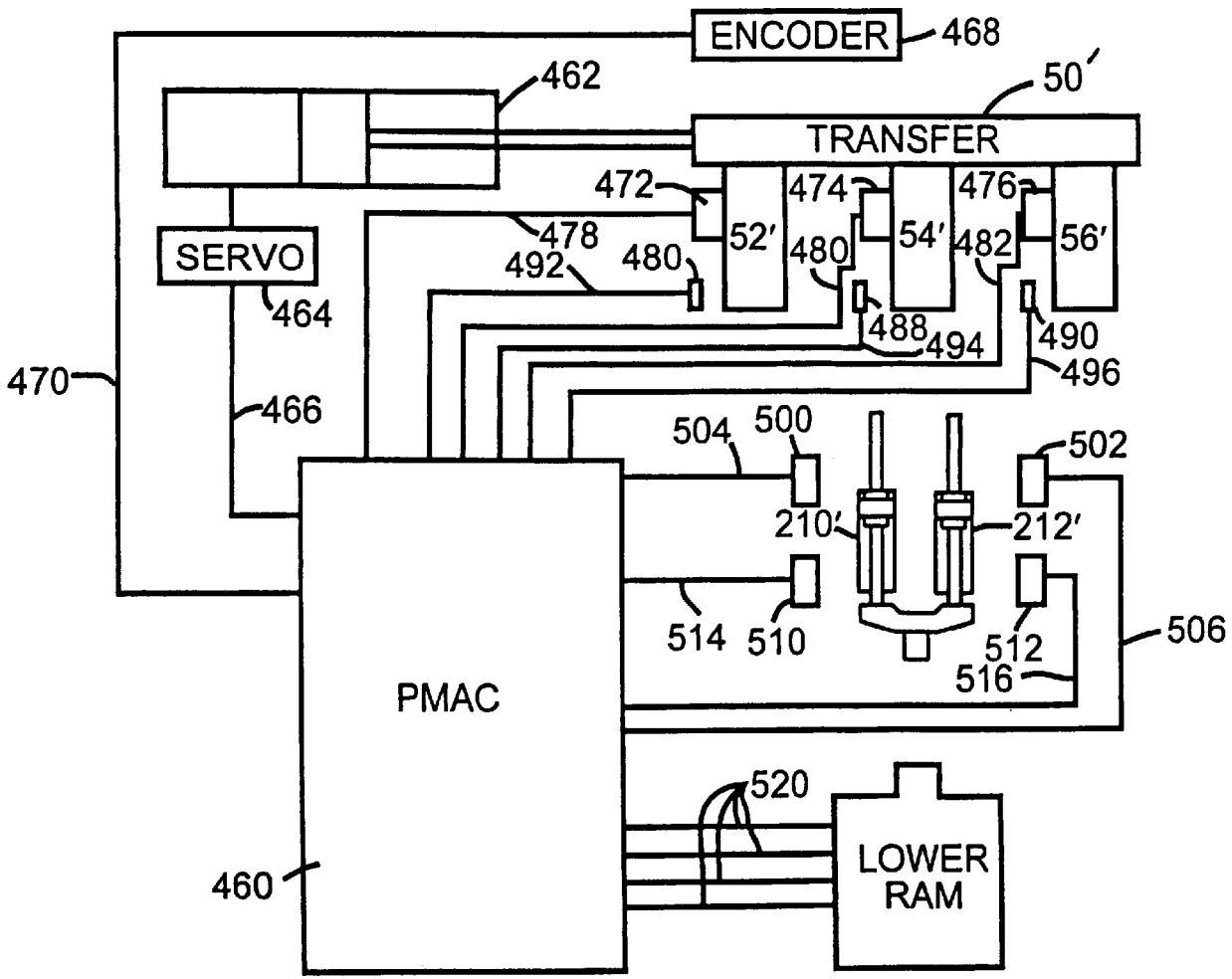
FIG. 12 is a block diagram of the control system for the machine of the present invention.

FIG. 12 briefly illustrates the relationship between the machine control system and the components previously described. The system includes a programmable multi-axis controller 460 which enables the tool movements to be controlled as programmed axes moves thereby eliminating the need for mechanical stops and associated hardware. For a more detailed description of a multi-axis controller employed in an automatic fastening machine, reference may be made to the aforementioned U.S. patent application Ser. No. 08/937,979 the disclosure of which is incorporated by reference. In the arrangement of FIG. 12, transfer plate 501 is moved by cylinder 462 under control of servo valve 464. Control of valve 464 by controller 460 is represented by line 466. Positional information from transfer encoder 468 is sent to controller 460 via line 470.

In FIG. 12, tools 52', 54' and 56' are moved by cylinders under control of servo valves 472, 474 and 476, respectively. Lines 478, 480 and 482 indicate control of these servo valves by controller 460. Positional information on tools 52', 54' and 56' is provided by encoders 486, 488 and 490 and sent to controller 460 via lines 492, 494 and 496, respectively. Pressure foot cylinders 210' and 212' are operated by servo valves 500 and 502, respectively, under control of controller via lines 504 and 506, respectively. Positional information on pressure foot cylinders 210', 212', and therefore positional information on the pressure foot, is provided by LVDTs 510 and 512 and sent to controller 460 via lines 514 and 516. The lines collectively represented 520 in FIG. 12 represent commands sent to servo controls in the lower ram for raising and lowering the ram and for operating the turntable, and the lines also represent information sent back to controller 460 from the load cells in the ram and from encoders and LVDTs providing information on the position of the ram and the position of the turntable. While the various motive means in the arrangement of FIG. 12 are shown and described as fluid cylinders, one or more or even all of the motive means can be electrically operated actuators such as ball screw actuators, the roller screw actuator shown and described in U.S. Pat. No. 5,829,115 issued Nov. 3, 1998 and entitled "Apparatus And Method For Actuating Tooling", the disclosure of which is hereby incorporated by reference, and other types of actuators. Thus, by utilizing the actuator of the foregoing patent and other electrically operated actuators such as ball screw actuators for all of the motive means in the arrangement of FIG. 12, an all-electrically operated automatic fastening machine can be provided.

Figure 14:
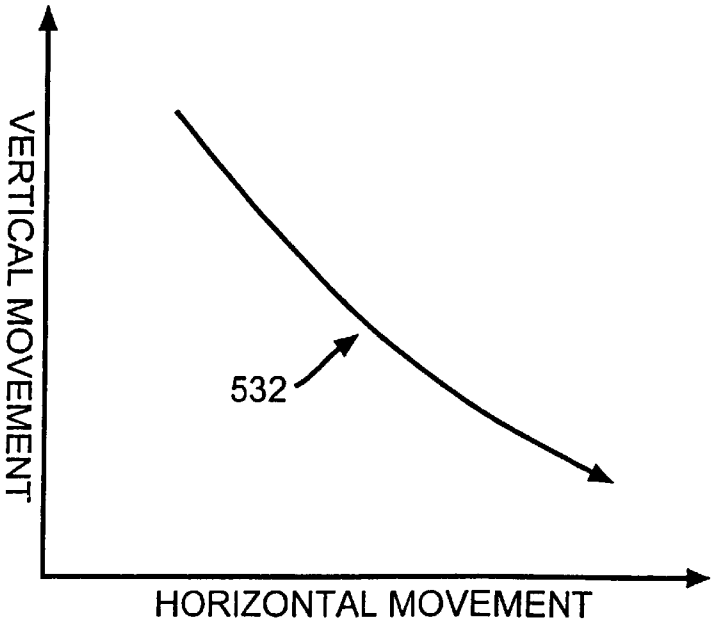
FIG. 14 is a graph illustrating operation of the machine of the present invention.
Figure 13:
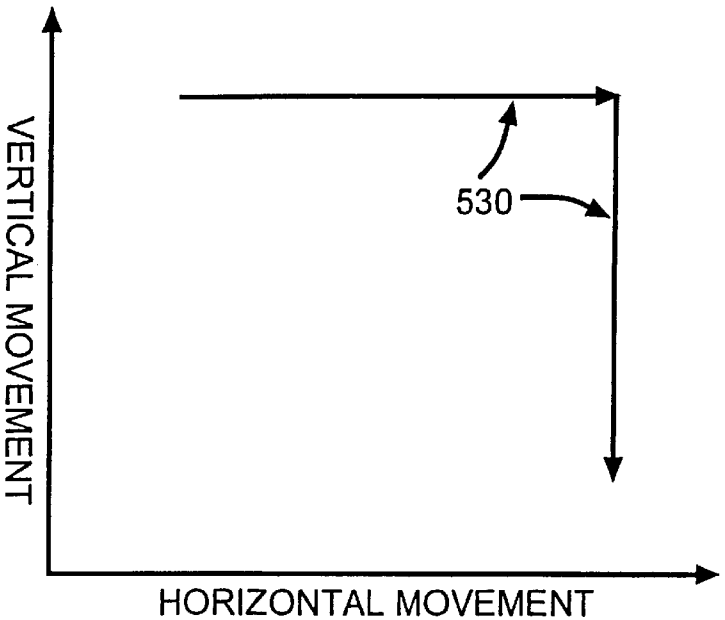
FIG. 13 is a graph illustrating operation of prior art machines.

Thus, the control system illustrated in FIG. 12, which employs the multi-axis controller 460, provides servo control on multiple axes. This, in turn, allows profiling of the movements of the tools. In particular, the conventional way to move tools was to first move the transfer plate to move the tool horizontally to a position coinciding with the work axis. Then the tool was moved vertically toward and away from the workpiece. The path 530 shown on FIG. 13 represents such conventional movement of a tool such as drill 56. This movement is along paths substantially perpendicular to each other. With the control system of FIG. 12 providing servo control on multiple axes, the tool movement can include a combination of horizontal and vertical movements, i.e., a combination of substantially orthogonal movements. In particularly, as transfer plate 50 moves horizontally, the tool such as shave tool 54' begins to move downwardly rather than waiting for the transfer head to complete its movement. Such a tool path or profile is represented by the curve 532 in FIG. 14 and is possible because of the servo control of the various axes. This reduces machine cycle time.

Figure 15:
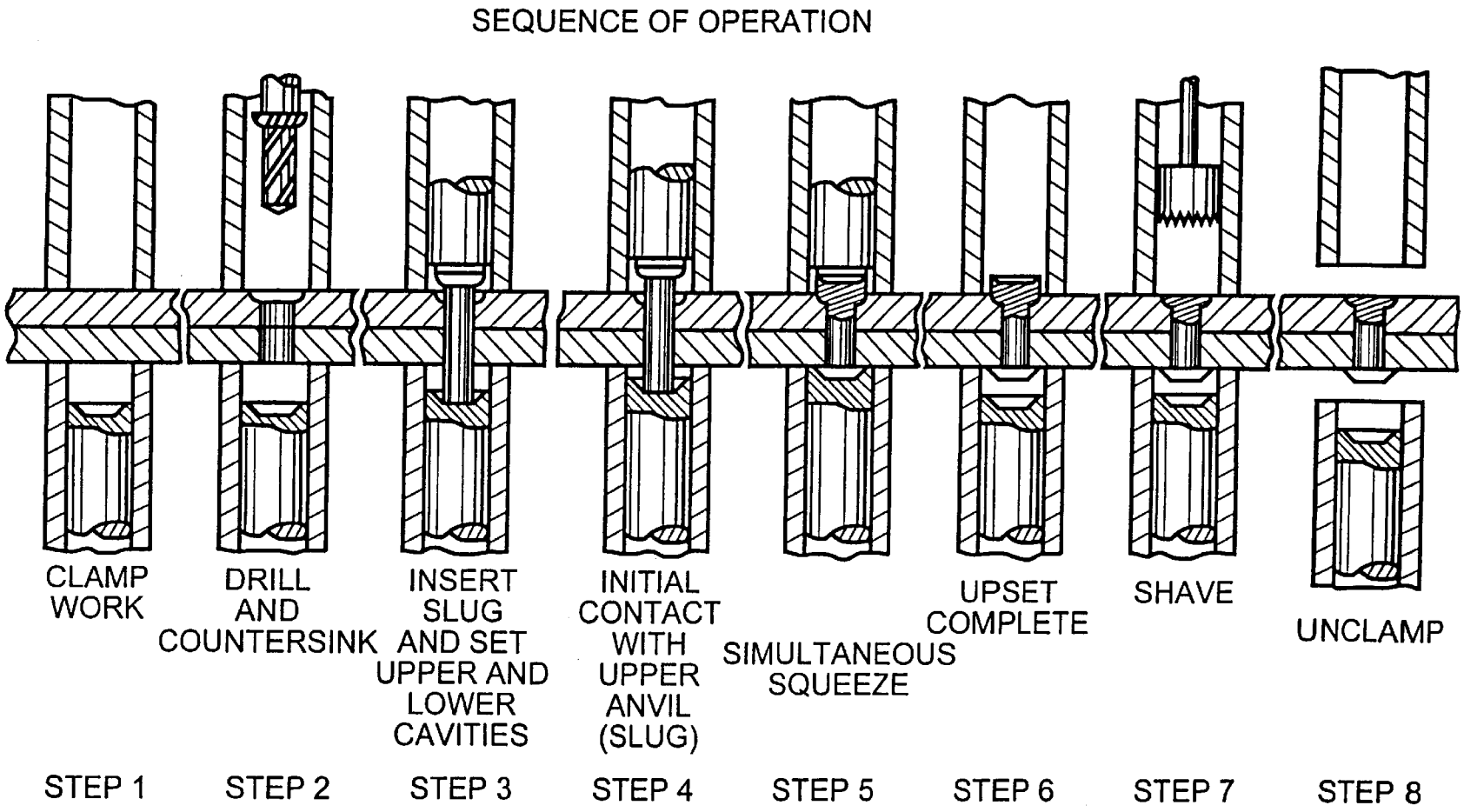
FIG. 15 is a sequence diagram illustrating a snug riveting process performed by the machine of the present invention.

The machine and method of the present invention can be used in a slug riveting process. A basic slug riveting method and apparatus is disclosed in U.S. Pat. No. 4,908,928 issued Mar. 20, 1990 entitled "Slug Riveting Method And Apparatus" and assigned to the assignee of the present invention, the disclosure of which is hereby incorporated by reference. A slug riveting process according to the present invention is illustrated in FIG. 15. In steps nos. 1 and 2 a relatively deeper cavity is established to accommodate a longer drill length for use with a range of various stack thicknesses. This avoids the need to change the drill. In step no. 3, the lower cavity is set while the slug 604 is being fed into place. The stopping point of the upper tool 606 establishes the upper cavity. Step no. 4 is the snug step. only the lower tool 608 is moved. The fastener is locked in the hole. If everything is proper, the machine control system will detect the snug force via the upset load cell 380 in the lower ram. Then the operation proceeds to step no. 5 designated simultaneous squeeze. In the squeeze step the upper and lower rams move together. Both must reach the end point at the same time. The forces applied by the upper and lower rams will be equal, the amount of force being controlled by closed loop control of the upset load cell 380 via the machine control system, but the distances travelled by the respective rams may or may not be equal depending upon the fastener itself, the style of tooling, the form of the die button, etc.

It is therefore apparent that the present invention accomplishes its intended objects. While an embodiment of the present invention has been described in detail, that is done for the purpose of illustration, not limitation.

What is claimed is:

1. In an apparatus for installing fasteners in a workpiece comprising a frame and fastener installation tools carried by said frame and movable toward and away from said workpiece for installing fasteners therein, said workpiece being disposed in a workpiece plane, a pressure foot assembly comprising:

a) a pressure foot plate disposed in a first plane substantially parallel to the workpiece plane;

b) motive means carried by said frame, said motive means orientated along an axis substantially perpendicular relative to said first plane, for moving said pressure foot plate toward and away from said workpiece; and c) means for coupling said motive means to said pressure foot plate in a manner allowing tilting of said pressure foot plate from a position initially being disposed in the first plane, along a path substantially parallel to said axis to a position in a second plane disposed at an acute angle, relative to said first plane, during relative movement between said apparatus and said workpiece from one fastener installation location to another.

2. Apparatus according to claim 1, wherein said motive means comprises a pair of motive means in spaced location and wherein said means for coupling comprises means for providing a pivotal connection between one of said motive means and said pressure foot plate and means for providing a sliding connection between the other of said motive means and said pressure foot plate at a location thereon spaced from said pivotal connection.

3. Apparatus according to claim 1, wherein a workline is established by the location of said workpiece prior to operation of said tools to install fasteners in said workpiece and further including:

a) sensor means operatively associated with said motive means for monitoring movement of said pressure foot plate; and b) control means for utilizing information from said sensor means for causing movement of said pressure foot plate in reaction to force applied to said workpiece during fastener installation to maintain said workline in position.

4. In an apparatus for installing fasteners in a workpiece comprising a frame and fastener installation tools carried by said frame and movable toward and away from said workpiece for installing fasteners therein, said workpiece being disposed in a workpiece plane, a pressure foot assembly comprising:

a) a pressure foot plate disposed in a first plane substantially parallel to the workpiece plane;

b) first and second motive means carried by said frame in a space relation, said first and second motive means each orientated along an axis substantially perpendicular relative to said first plane, for moving said pressure foot plate toward and away from said workpiece;

c) first and second connecting means for connecting said first and second motive means, respectively, to said pressure foot plate at spaced locations therealong; and d) said first and second connecting means having a structural relationship which allows tilting of said pressure foot plate from a position initially being disposed in the first plane, along a path substantially parallel to said axis to a position in a second plane disposed at an acute angle, relative to said first plane, during relative movement between said apparatus and said workpiece from one fastener location installation location to another.

5. Apparatus according to claim 4, wherein one of said connecting means provides a pivotal connection between said pressure foot plate and one of said motive means and the other of said connecting means provides a sliding connection between said pressure foot plate and the other of said motive means.

6. Apparatus according to claim 4, wherein a workline is established by the location of said workpiece prior to operation of said tools to install fasteners in said workpiece and further including:

a) sensor means operatively associated with said motive means for monitoring movement of said pressure foot plate; and b) control means for utilizing information from said sensor means for causing movement of said pressure foot plate in reaction to force applied to said workpiece during fastener installation to maintain said workline in position.

7. In apparatus for installing fasteners in a workpiece comprising a frame and fastener installation tools carried by said frame and movable toward and away from said workpiece for installing fasteners therein, said workpiece being disposed in a plane, a pressure foot system comprising:

a) a pressure foot plate disposed in a plane substantially parallel to the plane of said workpiece;

b) first and second fluid cylinders carried by said frame in spaced relation and each having a piston and a rod connecting the piston thereof to said pressure foot plate at spaced locations thereon for moving said pressure foot plate toward and away from said workpiece;

c) a fluid circuit connected to each of said first and second fluid cylinders and each at opposite sides of the pistons thereof and connected to fluid pressure and fluid tank lines;

d) a first servo-controlled valve in said fluid circuit for selectively connecting said pressure and tank lines to opposite sides of the piston of said first fluid cylinder;

e) a second servo-controlled valve in said fluid circuit for selectively connecting said pressure and tank lines to opposite sides of the piston of said second fluid cylinder; and f) control means connected in controlling relation to said first and second servo-controlled valves;

g) whereby said first and second fluid cylinders can be operated independently of each other for movement of said pressure foot plate toward and away from said workpiece.

8. Apparatus according to claim 7, wherein said rods of said first and second fluid cylinders are connected to said pressure foot plate in a manner allowing tilting of said plate relative to said plane during relative movement between said apparatus and said workpiece from one fastener installation location to another.

9. Apparatus according to claim 7, further including:

a) on-off valves in said fluid circuit between each of said first and second servo-controlled valves and the opposite sides of the pistons of each of said first and second fluid cylinders; and b) control means connected in controlling relation to each of said on-off valves;

c) so that said pressure foot plate can be held in any selected position in relation to said workpiece.

10. Apparatus according to claim 7, wherein a workline is established by the location of said workpiece prior to operation of said tools to install fasteners in said workpiece and further including:

a) sensor means operatively associated with said first and second fluid cylinders for monitoring movement of said pressure foot plate; and b) control means for utilizing information from said sensor means for causing movement of said pressure foot plate in reaction to force applied to said workpiece during fastener installation to maintain said workline in position.

11. In apparatus for installing fasteners in a workpiece comprising upper and lower ram means carried by a frame and movable toward and away from opposite surfaces of said workpiece:

a) clamp means carried by said lower ram means and movable in first and second directions into and out of contact with said workpiece; and b) means for positively driving said clamp means in both said first and second directions.

12. Apparatus according to claim 11, wherein said clamp means comprises a clamp piston and a clamp cylinder surrounding said piston and wherein said means for positively driving said clamp means comprises first and second annular chambers between said cylinder and said piston axially spaced and sealed from each other and means for selectively introducing fluid to and withdrawing fluid from said chambers depending upon the direction said clamp piston is to be moved relative to said clamp cylinder.

13. Apparatus according to claim 11, further including sensor means operatively associated with said clamp means for measuring movement of said clamp means.

14. Apparatus according to claim 11 further including a load cell operatively associated with said clamp means for measuring clamping force applied to the workpiece.

15. Apparatus according to claim 14, wherein said load cell is connected to a control system for providing closed loop control of force applied to the workpiece.

16. In apparatus for installing fasteners in a workpiece comprising first and second ram assemblies carried by a frame and movable toward and away from opposite surfaces of said workpiece:

a) a body for carrying a ram tool;

b) means for supporting said body on an end of one of said ram assemblies; and c) means on said ram assembly for rotating only said body so as not to interfere with additional components on said ram assembly.

17. Apparatus according to claim 16, wherein said body is cylinderal in shape and wherein said means for rotating only said body comprises a ring gear on said body, motor means and gear means for coupling the output of said motor to said ring gear for rotating said body.

18. Apparatus according to claim 16, further including encoder means operatively coupled to said body for detecting the amount and direction of rotation of said body.

19. Apparatus according to claim 18, further including encoder means for detecting the amount and direction of rotation of said body and gear means for coupling said ring gear to said encoder.

20. In an automatic apparatus for installing fasteners in a workpiece including a plurality of tools for performing fastener installation operations on said workpiece, a transfer means and associated motive means for moving said tools into and out of alignment with a work axis and a corresponding plurality of motive means for moving said tools relative to said workpiece to perform said fastener installation operations:

a) a corresponding plurality of servo control devices operatively associated with corresponding ones of said motive means associated with said transfer means and with said tools for controlling the operation of said motive means; and b) a multi-axis motion controller connected in controlling relation to each of said servo control devices for controlling said fastener installation operations including movement of said transfer means and movements of said tools;

c) so that profiling of the movements of the tools is provided, the tool movements including a combination of substantially orthogonal movements during simultaneous movement of the transfer means and a tool.

21. In a method for installing fasteners in a workpiece including a plurality of tools for performing fastener installation operations on said workpiece, a transfer means and associated motive means for moving said tools into and out of alignment with a work axis and a corresponding plurality of motive means for moving said tools relative to said workpiece to perform said fastener installation operations:

a) controlling the operation of said motive means associated with said transfer means and with said tools by a corresponding plurality of servo control devices operatively associated with corresponding ones of said motive means;

b) controlling said fastener installation operations including movement of said transfer means and movements of said tools utilizing a multi-axis motion controller connected in controlling relation to each of said servo control devices; and c) profiling the movements of the tools by simultaneously moving said transfer means and a tool to provide substantially orthogonal movements.

22. A method of riveting two or more side-by-side workpieces together, the workpieces being provided with aligned apertures in which a slug rivet has been received, said method comprising the following steps:

a) providing first and second riveting tool means aligned with the slug rivet, the first riveting tool means being disposed facing said one side of said one workpiece and the second riveting tool means being disposed facing the other side of another workpiece;

b) moving the first riveting tool means toward the workpiece in a programmed axis move under control of a multi-axis motion controller to establish a first desired die cavity;

c) moving the second riveting tool means towards the first riveting ram means in a programmed axis move under control of said controller to establish a second desired die cavity;

d) applying a snug force to the rivet by moving only one of the riveting tool means; and e) moving both of the riveting tool means to perform a simultaneous squeeze operation on the rivet wherein the forces applied by the first and second riveting tool means are equal, the distances travelled by the first and second riveting tool means are determined by the slug rivet and the nature of the riveting tool means and wherein both of the riveting tool means reach an end point at the same time.

23. A method according to claim 22, further including detecting the snug force prior to performing the simultaneous squeeze operation.

* * * * *

UNITED STATES PATENT AND TRADEMARK OFFICE

CERTIFICATE OF CORRECTION

PATENT NO. : 6,295,710 B1
DATED : October 2, 2001
INVENTOR(S) : Roberts et al.

It is certified that error appears in the above-identified patent and that said Letters Patent is hereby corrected as shown below:

Title page,
In the inventors section, the first named inventor's name is incorrectly spelled as "Bradly M. Roberts."

The correct spelling of the first named inventor's name is -- Bradley M. Roberts. --

Figure 15, the word "SLUG" in Step 4 of the sequence of operation is incorrect, and should read "SNUG" as shown here:

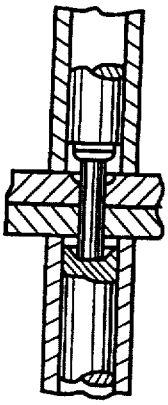

INITIAL CONTACT WITH UPPER ANVIL (SNUG)

STEP 4

Signed and Sealed this

Twelfth Day of March, 2002

*Attest:*

*Attesting Officer*

JAMES E. ROGAN
*Director of the United States Patent and Trademark Office*